United States Patent [19]

Bobkowicz

[11] 4,209,965

[45] Jul. 1, 1980

[54] UNIVERSAL SPINNING SYSTEM

[76] Inventor: Emilian Bobkowicz, 400 Kensington, Westmount, Quebec, Canada

[21] Appl. No.: 902,385

[22] Filed: May 3, 1978

Related U.S. Application Data

[63] Continuation of Ser. No. 752,901, Dec. 21, 1976, abandoned.

[51] Int. Cl.[2] ..... D01H 1/12; D01H 13/30; D02G 3/40

[52] U.S. Cl. ..... 57/5; 57/7; 57/309; 57/327

[58] Field of Search ..... 57/3, 4, 5, 6, 7, 9, 57/12, 34 R, 35, 58.89–58.95, 156, 157 R, 157 F, 157 TS, 160, 162, 164, 327, 309

[56] References Cited

U.S. PATENT DOCUMENTS

| | | | |
|---|---|---|---|
| 3,439,491 | 4/1969 | Scruggs | 57/160 |
| 3,445,993 | 5/1969 | Vorisek | 57/58.95 X |
| 3,484,403 | 11/1969 | Bobkowicz et al. | 57/35 X |
| 3,494,118 | 2/1970 | Bobkowicz et al. | 57/58.95 X |
| 3,696,600 | 9/1974 | Mayer et al. | 57/160 X |
| 3,844,097 | 10/1974 | Bobkowicz et al. | 57/35 X |
| 3,844,103 | 10/1974 | Sasaki et al. | 57/160 X |
| 3,845,611 | 11/1974 | Senturk | 57/5 |
| 3,924,396 | 12/1975 | Bobkowicz et al. | 57/35 |
| 3,987,612 | 10/1976 | Bobkowicz et al. | 57/35 X |
| 4,056,924 | 11/1977 | Umiastowski | 57/5 |

*Primary Examiner*—Donald Watkins
*Attorney, Agent, or Firm*—McFadden, Fincham & Co.

[57] ABSTRACT

The present invention provides a process and apparatus for manufacturing yarn products comprised of an inner core of fibers and an outer layer of fibers. In the process, first fibers have a pre-twist imparted thereto to form a strand which becomes the inner core of the yarn and the pre-twist is retained by passing the yarn between two pinch points. While between the two pinch points, second fibers are juxtaposed to the strand and any untwisting tendency by the inner strand will tend to twist the outer layer of fibers. Optionally, the yarn may undergo a further twisting operation while between the two pinch points after the second fibers have been deposited.

19 Claims, 9 Drawing Figures

UNIVERSAL SPINNING SYSTEM

This is a continuation, of application Ser. No. 752,901, filed Dec. 21, 1976, now abandoned.

This invention relates to a method and apparatus and more particularly, to a method and apparatus suitable for forming yarns.

The spinning of fibers to form a yarn is an old process well known in the art. The twisting of the fibers to form a coherent yarn structure by retaining an adequate amount of twist represents one of the limiting factors in the production of yarn at high speeds. In the art, it has been maintained that in order to impart and retain a twist in a strand of yarn which is comprised of staple fibers, one end of the strand must be free to rotate. in other words, if any attempt is made to impart twist to a continuous strand of staple fibers which is fixedly held at both ends, right hand twist will appear on the strand at one side of the twisting device which will be offset by left hand twist in the strand on the opposed side of the device. As a result, the net twist will be zero with the right hand and left hand twists nullifying each other. This process is known as false twisting.

In order to overcome the above, the prior art has proposed (1) rotating transaxially the yarn collecting package; or (2) rotating transaxially the fiber supply strand to which a discontinuous loose stock is continually applied.

The concept of rotating the yarn collecting package is commonly known as ring spinning and includes flyer, cap and pot spinning. The concept of rotating the fiber feed in strand while passing through a revolving pot rotor is commonly known as open end rotor spinning. The transaxial rotation of the yarn package in ring spinning and the rotor pot in open end spinning inherently are technological limitations in yarn production in respect to fibers, spindles and speeds.

Although all of the above methods will produce a twisted yarn, the linear production speeds and consequent economical and technological disadvantages with respect to the inherent complexity and limitations of the hitherto used systems has been found to be a serious bottleneck towards meaningful technological progress in fiber to spun yarn conversion.

Thus, while the traditional methods of manufacturing yarn and like materials have been carried on for a number of years, the concept of either having to rotate the yarn collecting package or the fiber supply has imposed technological limitations on the speed and efficiency of such systems.

In more recent developments in the art, there have been proposed methods and apparatuses suitable for the manufacture of "composite" yarns. The term "composite yarn" is employed in the sense that such a yarn comprises two or more layers of yarn-forming material in the final yarn product. The material or materials forming each layer may be identical or of different types of fibers. The development of these composite yarns in the prior art has permitted the "engineering" of desired properties into the yarn product. The composite yarns are formed by employing a thermoplastic substance in combination with the fibers. Various methods have been taught in the art to achieve such structures.

As will be seen from the above brief descriptions, the manufacture of composite yarn comprising a polymeric material binding the fibers together represents a completely new concept which overcomes many of the technological limitations present in the ring and pot spinning methods. Yarns can be produced by the methods and apparatuses at speeds heretofore unattainable. However, for many applications, the textile industry prefers yarns of a 100% staple fiber content. These yarns must then be manufactured by the ring or pot spinning method.

With the present invention, there is described a method and apparatus for producing novel yarn structures, and which yarns can be produced at high speeds, without requiring the inclusion of a thermoplastic substrate in the yarn to bind the fibers together.

In one aspect of the present invention, there is provided a method suitable for manufacturing a yarn product, the method comprising the steps of supplying first fibers, imparting a pre-twist to said first fibers to form a strand, passing said strand between first and second pinch points, and while said strand is between said first and second pinch points, juxtaposing second fibers with said strand to form a yarn product.

In a further aspect of the present invention, there is provided an apparatus suitable for manufacturing a yarn product, the apparatus comprising means for supplying first fibers, means for imparting a pre-twist to said first fibers to form a strand of the same, means forming first and second pinch points through which said strand passes to maintain the pre-twist imparted to said first fibers, and means for juxtaposing second fibers with said strand while said strand is between said first and second points.

In a further aspect of the present invention, there is provided a yarn product comprising an inner core and an outer layer about said inner core, said inner core being formed of first fibers twisted in the S direction, said outer layer being formed of second fibers twisted in the Z direction.

In a preferred aspect of the method and apparatus embodiments of the present invention, there are provided means for twisting the first and second fibers, said means being intermediate said first and second pinch points.

In greater detail, the first fibers to which a pre-twist is imparted to form a strand may be of any material capable of being formed to a pre-twisted strand; such fibers may include those from material including numerous natural and man-made fibers, for example, cotton, wool, jute, flax, various polyesters, etc.

The first fibers may be delivered from any suitable source of the same. In one embodiment of the apparatus, the fibers are supplied by a lickerin assembly which includes an opening roll for the purpose of combing and drafting fibers from a fibrous web.

In the present invention, the strand has a pre-twist imparted thereto prior to the juxtaposition of the second fibers. As will be understood by those skilled in the art, the strand of first fibers may be supplied as a twisted strand; the strand being formed by the method and apparatus described herein, or alternatively, by conventional means if so desired. The pre-twisting of the fibers may be accomplished by any suitable means known for the purpose of twisting fibers; in one preferred embodiment of the present invention, the pre-twisting is accomplished employing aerodynamic forces.

In this embodiment employing aerodynamic forces, a vortical flow is imparted to a stream of fluid material and the fibers are introduced into this stream and assume a like spiral or vortex configuration. Preferably, the fluid is a pressurized gaseous material and even more preferably, air with or without additives is employed. One convenient means of imparting the vortical flow to the gaseous material may comprise directing a source of the gaseous material through the aperture of a disc which is spirally notched around the annulus. Such a disc may be spiralled in either the S direction or Z direction to impart the desired configuration to the gaseous material and thereby to the fibers. Preferably, such a disc is readily replaceable by other similar discs which have different angles of spiral thereby permitting one to vary the exact configuration of the aerodynamic forces according to the type of fibers being employed. In other words, depending on the fiber length, stiffness, etc., the aerodynamic forces may be adjusted in order to achieve the desired spiral or vortex configuration imparted to the fiber, and thus the pre-twist.

As will be understood by those skilled in this art, alternate means and devices may be used for imparting a vortical flow to a fluid. Thus, well known vortical chambers having inlets for the pressurized fluid material substantially tangential to the chamber may be used.

Additionally, the pressurized gaseous material may contain desired agents for treating or modifying the properties of the fibers. For example, the gaseous material may be heated so as to soften certain types of fibers to render them more pliable and susceptible to being influenced by the direction of the aerodynamic forces. Furthermore, agents such as lubricating agents including water or the like, soluble or insoluble bonding agents, etc. may be added to the gaseous material.

The first fibers which, as aforementioned, may be produced by a lickerin assembly, are directed into the flow of gaseous material having the vortical flow. In one embodiment, the fibers may be doffed from the opening roll and directed into a channel or conduit having a vortical flow of gaseous material therein. As will be appreciated by those skilled in the art, the means for imparting the vortical flow to the gaseous material need not include the spirally notched disc; rather, one or more sources of pressurized gaseous material may be directed in the desired configuration employing various feed means.

If so desired, the aerodynamic fiber delivery system may employ a convergent tubular device. In a particular embodiment, the tubular delivery system will force the fibers within the tube in a helical screw type path. In this embodiment, pressurized gaseous material will be directed to orifices or apertures in the desired direction to force the fibers to revolve in the screw-type path within the tube at a high velocity. Also, as aforementioned, the gaseous material may include agents to modify the properties of the fibers such as, for example, softening agents, surfactants, inert or active chemical gases, other fluid materials, etc. Still further, the pressurized gaseous material may be directed in a jet configuration which will achieve a texturizing effect on the fibers.

The pre-twist is imparted to the fibers through the combination of the aforementioned means of imparting a spiral motion to the fibers along with the establishment of a first pinch point while said fibers have the desired spiral or vortex configuration. To this end, the fibers may be deposited on a movable surface to form a layer of the same, and in extremely close proximity to the point at which they are deposited on said movable surface, a pinch point is created. This may conveniently be achieved by supplying a pressure roll or like device in proximity with the movable surface or fiber receiving means. Thus, when the initial or "head" portion of a fiber reaches said pinch point, it is held in a fixed position while the opposed end or "tail" of the fiber is free to rotate due to the spirally configurated aerodynamic forces. These forces will cause the tail of the fiber to rotate and twist around like fibers to form a twisted strand of the same.

In one embodiment of the apparatus, the fiber receiving means or movable surface upon which the layer of first fibers is formed may comprise a grooved suction roll such as is known in the art. Basically, it comprises a rotatably driven roll having a groove therein into which the fibers are placed to form a layer of the same and means within the groove for creating a suction to hold and retain the fibers thereon.

As a further essential feature of the present invention, a second pinch point is created downstream in the direction of the yarn or strand advancement.

While the strand of first fibers is held in said pre-twisted condition, second fibers are placed in juxtaposition to the pre-twisted strand. The supply of second fibers, in a manner similar to that discussed with respect to the supply of first fibers, may be achieved by many suitable apparatuses. To this end, a lickerin assembly combing and drafting fibers from fibrous material may be employed. Similarly, any conventional means of delivering the fibers in juxtaposition to the strand on the fiber receiving means is within the scope of the present invention. In the preferred embodiment, a lickerin assembly similar to that discussed above with respect to the supply to the first fibers and aerodynamic means for delivering the second fibers into juxtaposition with the pre-twisted strand are utilized. The second fibers may be delivered in a direction co-current, countercurrent or intermediate thereof with respect to the direction of travel of the strand of first fibers. Still further, the second fibers may be either similar or dissimilar with respect to the first fiber type.

After the second fibers have been juxtaposed to the strand of first fibers, the combined material may then pass through the second pinch point and be wound on a yarn package.

In one embodiment, the combined material may be subjected to a false twisting step intermediate the first and second pinch points. The false twisting may be achieved by any suitable means of which several will be illustrated in the preferred embodiments. It suffices to say that such false twisting devices are well known in the art and may be employed by the person skilled in the art in accordance with the teachings of the present invention.

Within the scope of the present invention, many modifications and additional features may be incorporated. For example, in one embodiment, the fiber receiving means or movable surface comprises a grooved suction roll wherein the groove having the suction surface is located in an offset position with respect to the center line of the first fibers delivered thereto. By so doing, the fibers will move to one side in their collection mode thus creating an overlapping staggered arrangement. Furthermore, this will bring in closer proximity the exit point for the yarn as will be discussed in greater detail hereinafter.

The false twisting means, when employed in the practice of this invention, may comprise a friction disc mounted coaxially with the grooved suction roll. A suitable guide means may be employed to retain the composite material in contact with the rotatably driven friction disc as it is taken off the suction roll. Alternatively, a separate twisting device comprising a friction spindle through which the yarn passes may be employed. In one preferred embodiment, a convex friction surface is employed which aids in preventing build-up and furthermore, creates a smooth yarn twisting effect. In addition, twisting means of a suitable type may be employed following exit of the yarn from the second pinch point.

As aforementioned, many different types of fibers may be employed to achieve the desired yarn construction. In one particular embodiment of the present invention, the first fibers may comprise relatively long staple fibers while the second fibers will be shorter length staple fibers which will give additional texture and bulk to the yarn; the longer length first fibers also enhance the operating characteristics of the process.

Many different yarn constructions may be achieved employing the above described method and apparatus. Thus, for example, when the first fibers have the pre-twist imparted thereto and the second fibers are juxtaposed to the strand of first pre-twisted fibers with no subsequent twisting operation, a double twisted yarn is formed. In other words, assuming the first fibers have a twist in the S direction and the second fibers, as delivered, have no twist whatsoever, the untwisting tendency of the first fibers which form the inner layer or core of the composite yarn will create a twisting effect in the opposite or Z direction in the second fibers or outer layer. An equilibrium point is reached wherein the inner layer of fibers will not untwist any further due to the counter forces of the outer layer.

This double or reverse twisted yarn construction may have an even "tighter" twist through the use of a twisting device between the first and second pinch points. Thus, if the first fibers forming the inner layer of the composite yarn have a pretwist in the S direction, the false twisting device may be operated so as to impart a twist to the outer layer of fibers in the Z direction. In this embodiment, the inner layer will thus have the pre-twist with the outer layer having a retained twist due to the interfiber slippage imparted by the false twisting device. Ordinarily, were it not for the pre-twist, the only twist retained would be due to interfiber slippage. However, when the normal untwisting tendencies occur for the outer layer, these forces will tend to more highly twist the inner layer. When these forces are counterbalanced, no further untwisting of the yarn in either direction can occur.

Still further, unidirectionally twisted yarn can be manufactured according to the process and apparatus teachings of the present invention. Again, assuming that the pre-twist imparted to the inner fiber layer is in the S direction, the false twisting means can also be driven so as to impart an S direction twist to the outer layer. The resultant sum of the twist will be larger than would otherwise be achievable solely by the use of a twisting device. The second twist imparted by the twisting device will be partially lost before entering the second pinch point, however there will be a retained twist due to interfiber slippage and the total twist will be equivalent to the original pre-twist plus the retained twist.

Many other desirable yarn constructions may be achieved employing modifications to the above described method and apparatus. For example, the second fibers may be delivered in juxtaposition to the strand of first fibers in a desired configuration including a spiral configuration similar to that described with respect to the delivery of the first fibers. This spiral configuration may be opposed to the spiral configuration of the first fibers. Still further, the present invention is not limited to two fiber sources. As will be appreciated, any number of fiber sources may be employed and further twisting devices used to achieve yarns having different twists.

In an optional embodiment, a carrier filament or strand may be employed in conjunction with the delivery of the first fibers. In this embodiment, the fiber will become twisted about the carrier and the second fiber may then be placed in juxtaposition to the carrier and first fibers and subjected to a twisting operation if so desired. A still further alternative embodiment comprises using a carrier coated with thermoplastic material such as will be achieved by running the carrier through an extruder. By so doing, a more positive locking of the fibers may be achieved. If so desired, the carrier, coated or uncoated, may be delivered in juxtaposition to the first fibers after the same have been deposited on the fiber receiving means or movable surface.

The apparatus, in the commercial embodiment thereof, may be constructed according to a modular concept to enable shipping and set-up of the same without dismantling of components. Thus, a central module may include vacuum and pressure supply and drive controls into which a plurality of the yarn-forming modules may be "plugged in".

Having thus generally described the invention, reference will be made to the accompanying drawings illustrating embodiments thereof, and in which.

Figure 1:
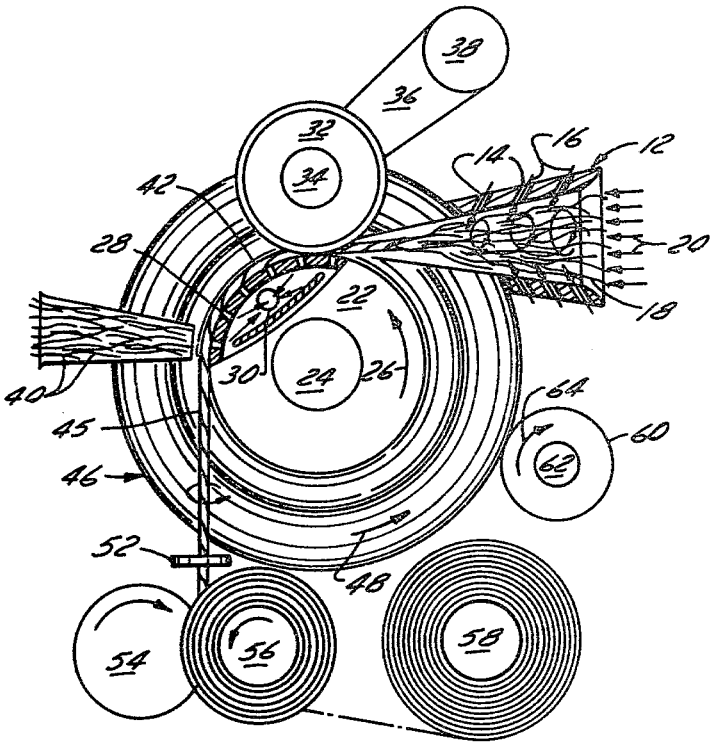
FIG. 1 is a side elevational view, partly in section, of an apparatus according to one aspect of the present invention.

Referring to FIG. 1 and by reference characters thereto, there is illustrated therein a yarn manufacturing apparatus employing two separate feeds of fibers.

The apparatus includes a convergent fiber delivering member 12 which has a plurality of apertures 14 through which a source of pressurized gaseous material (not shown) such as air is directed as shown by arrows 16. First fibers 18 are directed interiorly of member 12 in the direction indicated by arrows 20 whereby the individual fibers have imparted thereto a vortical flow due to the pressurized air directed through apertures 14 substantially tangential to the walls of member 12.

Fibers 18 are deposited on roll 22 journalled on shaft 24 and rotatably driven in the direction shown by arrow 26. Roll 22 is a suction roll and as such, includes a plurality of apertures 28 communicating with the interior of the roll wherein there is provided a conduit 30 connected to a suitable means of creating a negative pressure.

Located proximate the point wherein the fibers 18 are deposited on roll 22 is a pressure roll 32 journalled on a shaft 34. Pressure roll 32 is connected via arm 36 to mounting means 38; preferably, pressure roll 32 is biased by spring means or the like towards the surface of suction roll 22 and is freely rotatable. Thus, pressure roll 32 creates a first pinch point for strand 42 which comprises fibers 18 which are partially twisted due to the vortical flow of pressurized air delivered through apertures 14 in housing member 12.

Downstream from the first pinch point, a plurality of second fibers 40 are juxtaposed to strand 42. Fibers 40 may be pneumatically delivered from any suitable source of fibers. The combined material or yarn 45 thus comprises inner strand 42 having fibers 40 twisted thereabout.

The combined material is then passed against a revolving friction disc 46. The drive means for friction disc 46 comprises a roller 60 mounted on shaft 62 driven in the direction of arrow 64 and which is in contact with an edge of friction disc 46. As a result thereof, friction disc 46 is driven in the direction indicated by arrow 48. In a preferred embodiment, friction disc 46 is driven at a higher rotational speed than is suction roll 22. The resulting yarn is then passed through a guide ring 52 and between guide rollers 54 and 56 onto wind-up roll 58. Guide rolls 54 and 56 are mounted in juxtaposition to each other and as the yarn passes therebetween there is created a second pinch point.

The yarn formed by the above-described method and apparatus may have different configurations depending on the operating conditions of the process and apparatus.

Thus, in one embodiment of the invention, the arrangement of apertures 14 and the direction of pressurized air is such as to impart to fibers 18 which subsequently form strand 42 a twist in the S direction. In this respect, irrespective of what direction the twist is imparted to strand 42, this twist is achieved through the pinch point 44 created by pressure roll 32 in juxtaposition with the suction roll. Considering an individual fiber, the head of the fiber, when delivered to the pinch point 44, is securely held thereat. Meanwhile, the tail of the fiber is free to twist about similarly held fibers due to the vortex configuration of the pressurized air.

Strand 42 then has this S direction pre-twist held therein by the creation of first pinch point 44 and second pinch point 55. When the second fibers 40 are juxtaposed to the first layer of fibers, and there is subsequently imparted a further twist in the S direction by friction disc 46, the resultant sum of the twist will be larger than the friction twist disc alone could impart. When the twist is in the same direction as the pre-twist imparted to strand 42, a portion of the twist will be lost before entering the second pinch point between rolls 54 and 56 and the yarn will contain the sum of the original pre-twist plus the retained twist imparted by friction disc 46.

In an alternative embodiment, the twist imparted to strand 42 is in the S direction with the twist imparted by the friction disc 46 being in the Z direction.

In this embodiment, the friction disc will create counter torque and as a result thereof, the final yarn will contain an inner core or strand twisted in the S direction with an outer layer twisted in the Z direction. Thus, the yarn will contain the amount of twist imparted by friction disc 46 with the fiber slippage minus the pre-twist imparted to inner layer 42. This will thus give a yarn with a double or reverse twist simulating a ply yarn appearance. This yarn further cannot be untwisted per se since any attempt to untwist in one direction will only result in a tightening of the twist in the other direction.

To achieve the above results, the apparatus may be modified such that drive means 60 for rotating friction disc 46 is a reversible drive means. Thus, the same housing member 12 may be employed in both the embodiments and adapted to always give the yarn a pre-twist in a certain direction—i.e. the S or Z direction, with the friction disc 46 being capable of reversible rotation to produce a yarn twisted in only one direction or a yarn having the alternate or double twist.

The embodiment of FIG. 1 has been described with respect to the use of a high speed friction disc 46; it will be understood by those skilled in the art that in this embodiment, any suitable false twisting means may be employed. Furthermore, as previously discussed, the false twisting means may be eliminated whereby one would still obtain a double or a reverse twisted yarn.

Figure 3:
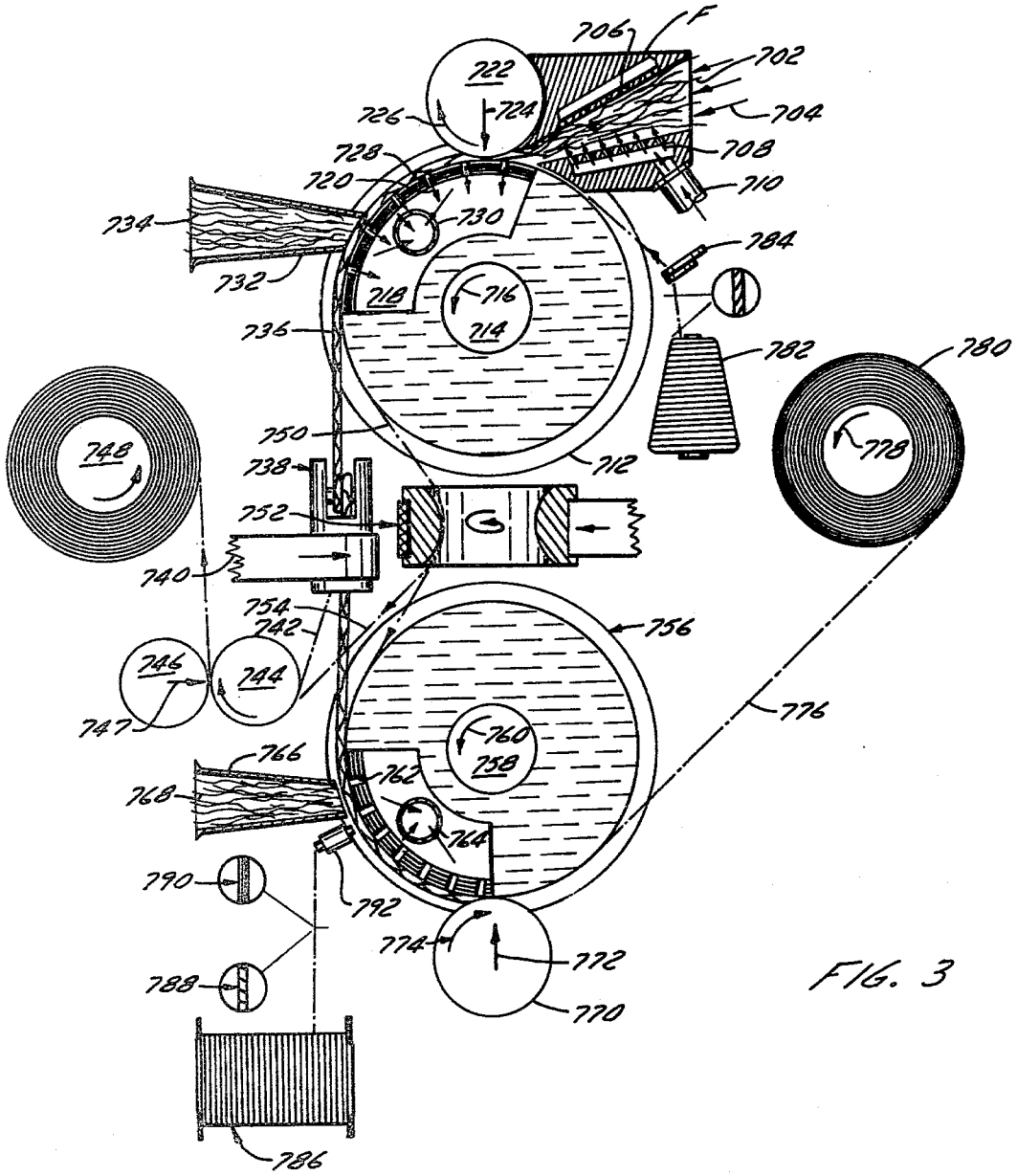
FIG. 3 is a side elevational view, partly in section of a further embodiment of a yarn-forming apparatus.

FIG. 3 of the drawings illustrates a basic apparatus such as was described with respect to FIG. 1 including many optional features.

In greater detail, first fibers 702 are fed to a chamber 706 as indicated by arrows 704; chamber 706 has a plurality of apertures tangential to the walls through which pressurized gaseous material is fed through conduit 710.

Fibers 702 thus have a pre-twist imparted thereto forming a strand whereafter they are deposited on a grooved suction roll 712 rotatably journalled on shaft 714 rotating in the direction of arrow 716. A suction chamber 718 to which a suction conduit 730 is operatively connected holds the fibers on suction roll 12 by means of apertures 720.

At the point of deposition of first fibers 702 on suction roll 712, a pressure roll 722 rotating in the direction of arrow 726 exerts pressure on the fibers as indicated by arrow 724 to form a strand 728 having a pre-twist held therein.

During the travel of strand 728 on suction roll 712, second fibers 734 introduced through chamber 732 are juxtaposed to the strand. The resulting yarn 736 may then be passed through a twister 738 driven by belt 740 emerging as a twisted yarn 742 which is then passed between a pair of rolls 744 and 746 to a wind-up roll 748. Roll 746 is biased against roll 744 as indicated by arrow 747.

Alternatively, yarn 736 may follow the path indicated by reference numeral 750 and pass through a twister 752 which will be described in greater detail hereinafter. The twisted yarn 754 will then be wound on wind-up roll 748.

In a still further embodiment, either yarns 736 or 754 are placed on a further suction roll 756 journalled on shaft 758 and rotatably driven in the direction of arrow 760. Suction roll 756 has a plurality of apertures 762 and a suction is created through conduit 764.

In the illustrated embodiment, third fibers 768 are delivered through chamber 766 and placed in juxtaposition with the yarn on suction roll 756. A further pressure roll 770 is mounted in juxtaposition to the yarn, roll 770 rotating in the direction of arrow 774 and being journalled against the yarn as indicated by arrow 772.

The resulting consolidated yarn 776 may be wound on a package 780 rotatably driven as indicates by arrow 778. Naturally, it will be understood that a further twisting operation may be employed on the three-fiber yarn.

In alternative embodiments, a continuous filament or carrier 782 is fed through guide ring 784 and deposited on suction roll 712 prior to the deposition of first fibers 702. Still further, a carrier material 786 may be fed through a guide 792 to suction roll 756. As illustrated in FIG. 3, carrier 786 may comprise a twisted yarn 788 or alternatively, a plurality of filaments 790 or a plurality of tapes.

Thus, as may be seen from the above, more than two fiber sources may be employed in manufacturing the yarn of the present invention. If so desired, after the deposition of each further fiber, the yarn may be twisted, preferably in alternating directions. Also, any number of fiber sources may be employed with or without the intermediate twisting operations.

Figure 4:
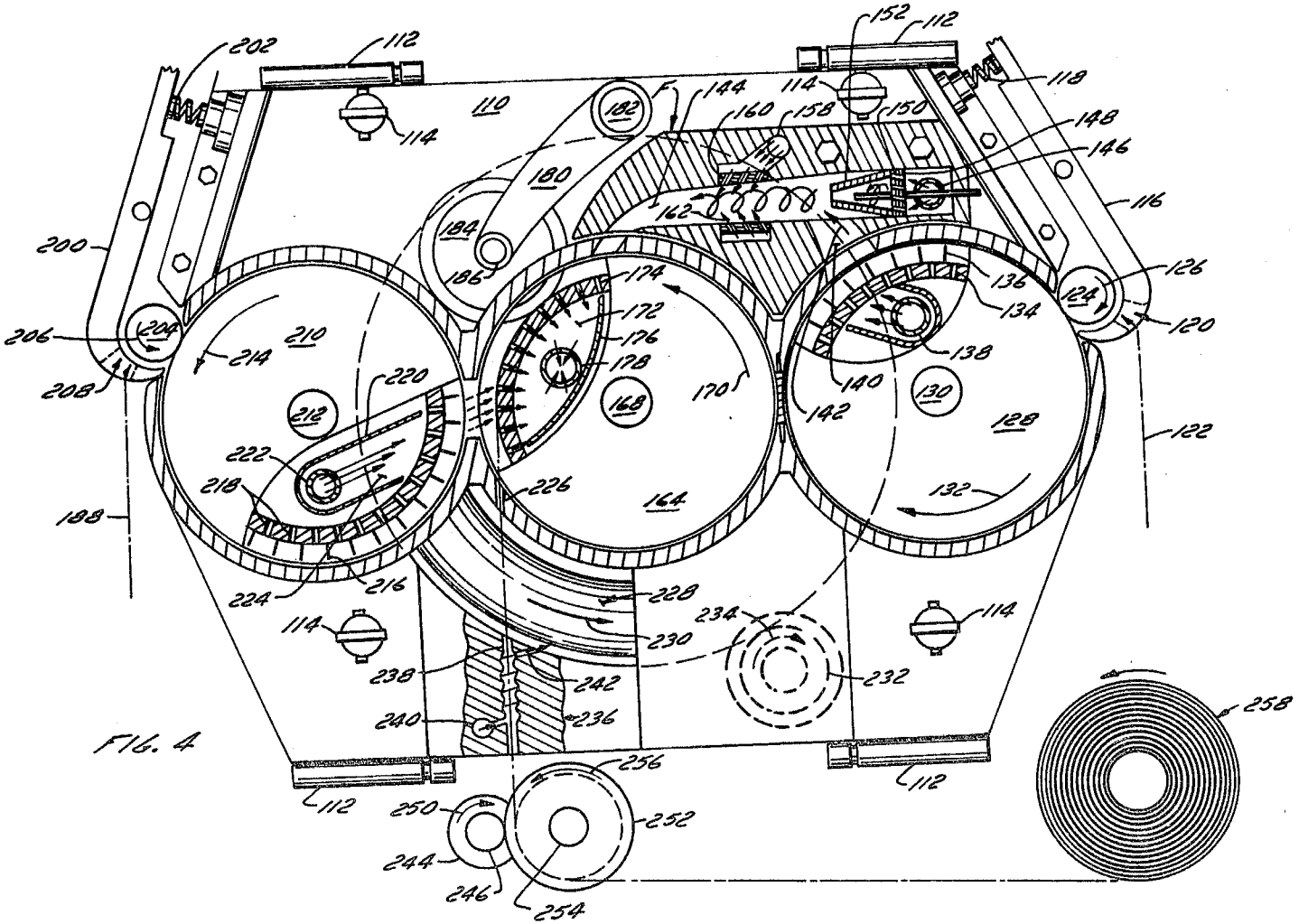
FIG. 4 is a side elevational view, partly in section, of a still further embodiment of a yarn-forming apparatus.

Turning to FIG. 4, there is illustrated therein an apparatus suitable for the manufacture of a composite yarn embodying the principles discussed with respect to FIG. 1.

In greater detail, the apparatus includes a face or cover plate 110 which is hingedly connected to frame F of the apparatus by means of hinges 112. Means for locking cover plate 110 to the frame comprises a plurality of rotatable locking bars 114.

Secured to the frame is an arm 116 biased by spring 118 which contains an aperture 120 therein. Fibrous material (not shown) is advanced as indicated by arrow 122 to a feed-in roll 124 rotatably driven in the direction designated by arrow 126.

Mounted in juxtaposition to feed-in roll 124 is an opening or lickerin roll 128 journalled on shaft 130 and rotatably driven in the direction of arrow 132. The circumferential surface of opening roll 128 includes a plurality of apertures 134 communicating with the interior of the roll; opening roll 128 also includes a plurality of needles or teeth 136 mounted on the circumferential surface. Mounted interiorly of roll 128 is a conduit 138 adapted to supply pressurized gaseous material to discharge the fibers from the surface of the roll as will be discussed hereinafter. In this respect, opening roll 128, in combination with feed-in roll 124, is adapted to draft, comb and substantially parallelize the fibers from the fibrous material. It will be understood that any conventional type opening roll known to those skilled in the art may be employed.

Within frame F there is provided a fiber discharge conduit 140; as the fibers pass over the portion wherein the pressurized gaseous material from conduit 138 is directed, they are directed through fiber discharge conduit 140 as shown by arrow 142. Conduit 140 communicates with a further internal conduit 144 which is instrumental in imparting a pre-twist to the fibers as will be described in greater detail.

Mounted in operative relationship to conduit 144 is a fluid supply conduit 146 connected to a source of pressurized gaseous material which is then discharged into conduit 144. The pressurized gaseous material is directed to a generally frusto-conical shaped convergent member 152 having a plurality of slots or apertures 150 in a disc 148. These apertures or slots 150 are angled or spiralled so as to impart the desired spiral or vortex configuration to the pressurized gaseous material as is schematically indicated by the arrow. As will be appreciated, the fibers discharged from opening roll 128 through conduit 140 will thus have imparted thereto a spiral or vortex configuration by the vortical fluid flow.

In the illustrated embodiment of FIG. 4, the apparatus includes a further conduit 158 connected to a source of pressurized gaseous material (which may be the same as that supplied to conduit 146) and which is directed to a further disc 160 having a plurality of apertures 162 to reinforce the vortex or spiral configuration attained by the fibers. As will be understood by those skilled in the art, one or more sources of pressurized gaseous material may be used depending on the distance of the fibers' travel and the type of fibers.

The apparatus further includes a suction roll 164 journalled on shaft 168 rotating in the direction indicated by arrow 170. As will be seen from FIG. 4, suction roll 164 includes an interior portion or cavity 172 bounded by the surface of the suction roll and plate 176 which is subjected to a vacuum or differential pressure through conduit 178. This differential pressure is effective in retaining the fibers within the groove of the suction roll as the air is withdrawn through apertures 174.

A pressure roll 184 is mounted in operative relationship with the groove on suction roll 164 and as may be seen from FIG. 4, the pressure roll is mounted through shaft 186 on an arm 180 which in turn is journalled on shaft 182. Pressure roll 184 is freely rotatable and applies pressure on the fibers in the groove and to this end, may be spring biased thereagainst. Furthermore, the illustrative arrangement permits pressure roll 184 to be "lifted" or swung out of the way when so desired.

Thus, as may be seen from the above description, fibrous material 122 is fed through feed-in roll 124 to opening roll 128 which combs and drafts the fibrous material to form a plurality of fibers. These fibers are then discharged through conduit 140 and have a vortex or spiral configuration imparted thereto in conduit 144 through the vortical flow of the pressurized gaseous material. These fibers are then deposited in the groove of suction roll 164 and advanced thereon past pressure roll 184.

These fibers will have a pre-twist imparted thereto. Thus, for example, when the fibers reach the point of juxtaposition of pressure roll 184 with the groove of suction roll 164, the "head" or initial portion of the fiber is held in a fixed relationship while the "tail" or other end of the fiber will still be subjected to the forces of the pressurized gaseous material. As may be visualized, the tail end of the fibers will then twist around other fibers whereby there is formed a twist in the strand formed of the fibers.

As was discussed with respect to FIG. 1, second fibers are then placed in juxtaposition with the strand formed of the first source of fibers. Conveniently, the second source of fibers may be drafted from a source of fibrous material as illustrated in FIG. 4.

To this end, the apparatus may include a fiberizing assembly including arm 200 spring biased 202 with frame F. Fibrous material 188 is fed through aperture 208 to feed-in roll 204 rotating in the direction of arrow 206.

Fibrous material 188 is advanced to opening roll 210 which is journalled on shaft 212 and rotatably driven in the direction of arrow 214. Opening roll 210, in a manner similar to opening roll 128, includes a plurality of needles or teeth 216 mounted on the circumferential surface thereof and further include apertures 218 communicating between the surface and the interior of roll 210.

Mounted interiorly of opening roll 210 is a conduit 222 communicating with an internal chamber 224 defined by walls 220. Conduit 222 is connected to a source of pressurized gaseous material which will discharge the fibers from the opening roll 210 onto the previously formed strand of fibers on suction roll 164. Thus, there is formed a yarn comprising an inner strand formed of a pre-twisted fibers with an outer layer of fibers.

In the illustrated embodiment of the apparatus, a friction disc 228 is rotatably driven in a direction of arrow 230. Conveniently, friction disc 228 may be driven through a drive roller 232 as shown by arrow 234. The resulting yarn will then pass through an aperture 226 in the housing about the suction roll 164 which serves to "guide" the yarn material and hold the same in juxtaposition to friction disc 228. Preferably, friction disc 228 is rotating at a high peripheral speed (even higher than suction roll 164) and will thus impart a twist to the composite yarn by the friction between the yarn and disc.

Optionally, and as illustrated in FIG. 4, the yarn may then be passed to a further operation to impart desired properties to the final yarn product. Thus, there is illustrated a device generally designated by reference character 236 having a central bore 238 extending therethrough. Located at the bottom of bore 238 is a conduit 240 connected to a source of pressurized gaseous material. The central or intermediate portion of bore 238 is configurated to impart a vortical motion to the gaseous material which will then exit through aperture or conduit 242. The portion of bore 238 having the spiral configuration to impart the desired configuration to the gaseous material may achieve the same through a number of suitable means. Thus, device 236 may have the bore initially formed with the spiral configuration or alternatively, it may comprise a cylindrical aperture having a wire or like helically wound member inserted therein.

The yarn then passes between a pair of rotating rolls 244 and 252 journalled on shafts 246 and 254 respectively and rotating in the direction of arrows 250 and 256. The yarn passes between the nip of rolls 244 and 252 thus creating a second pinch point, the first being the point between pressure roll 184 and the groove of suction roll 164. The yarn may then be wound on a suitable take-up package as indicated by reference numeral 258.

In the method of the present invention, with respect to the illustrated embodiment of FIG. 4, fibrous material 122 is formed into a plurality of discrete fibers by opening roll 128. These fibers are then discharged through conduit 140 and have a spiral or vortex configuration imparted thereto by directing a gaseous material in the same configuration. These fibers are then deposited on a suction roll and the creation of a pinch point along with the vortex configuration will form a strand of fibers having a twist imparted thereto.

The second source of fibers are formed from a fibrous material 188 by opening roll 210 and are placed in juxtaposition to the first strand of pre-twisted fibers. The resulting combined material is then subjected to friction twisting which may be in the same direction as the pre-twist imparted to the inner layer or first source of fibers or alternatively, in the opposite direction thereto. By passing through device 236, any loose fiber ends from the outer layer or second fibers will be helically wrapped around the strand. The second pinch point which enables the aforementioned operation to be achieved may conveniently be formed by a pair of rolls, the nip of which the yarn passes through.

Figure 2:
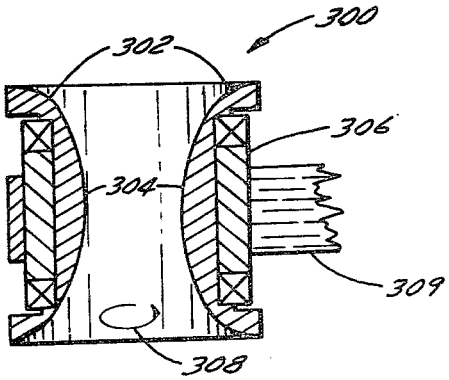
FIG. 2 is a side sectional view of a twisting device which may be employed in conjunction with the apparatus of the present invention.

Turning to FIG. 2, a further embodiment of a twisting device which may be employed in the practice of the present invention is illustrated. This twisting device is referred to generally by reference number 300 and, as illustrated, is a friction spindle through which the composite yarn product will pass. When passing therethrough, the yarn is maintained under a certain amount of tension by suitable guide means or the like whereby the yarn will be in continuous contact with a friction surface 302. In order to prevent build-up and create a smooth yarn twisting effect, the friction surface has a concave portion 304 which is inserted in the center of the friction bushing 306. The friction spindle may be rotatably driven by a drive belt 309 as indicated by arrow 308.

Figure 5:
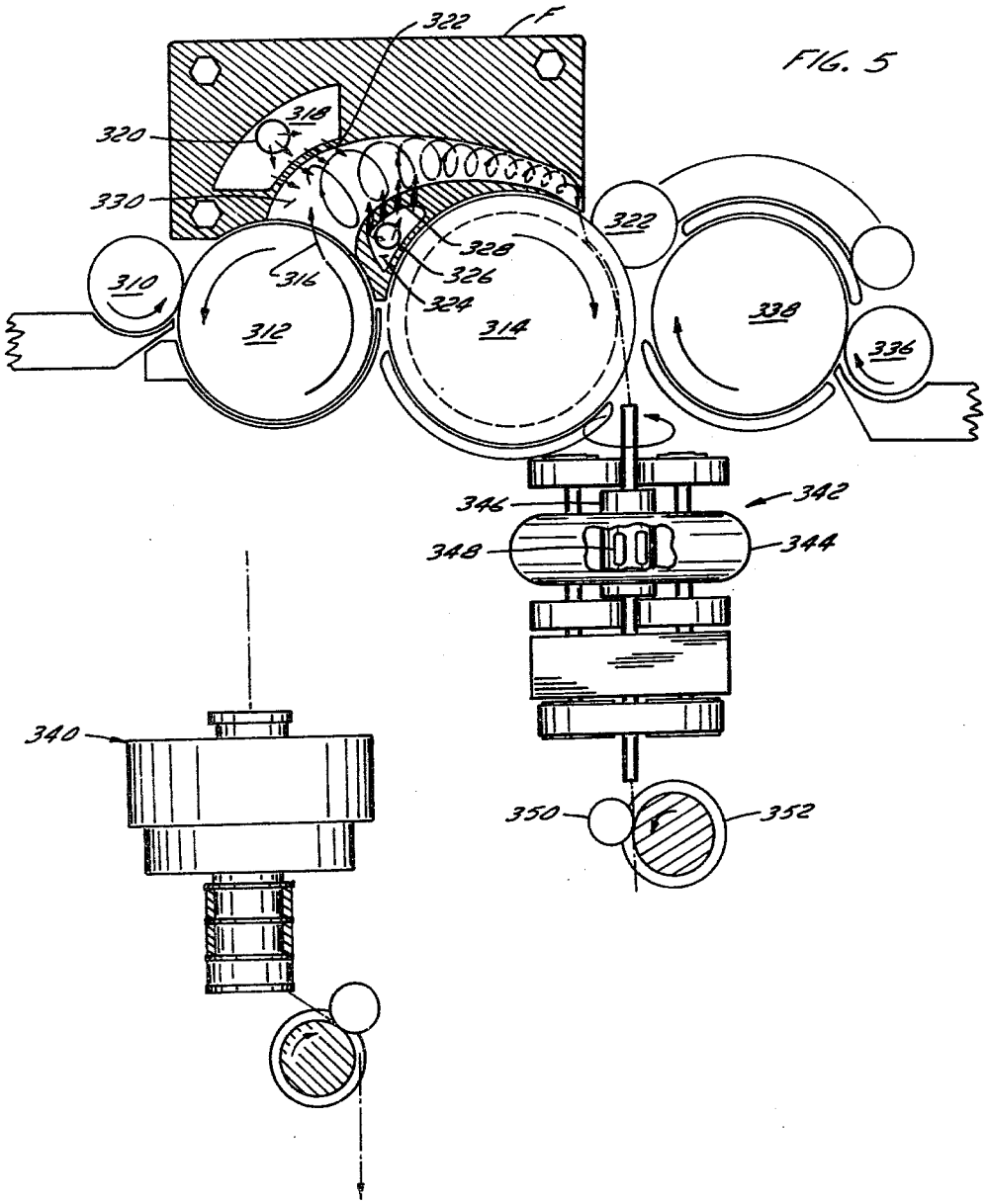
FIG. 5 is a further embodiment of a yarn-forming apparatus illustrating a different fiber delivery system and alternate twisting means.

Turning to FIG. 5, there is illustrated a further embodiment of a yarn-forming apparatus. In this illustrated embodiment, fibrous material is fed by feed in roll 310 to an opening roll 312 which may be constructed in the manner discussed with respect to FIG. 4. The combed and drafted fibers are then discharged (preferably by pneumatic means) as indicated by arrow 316 into an internal chamber 330 in frame F. Also contained within frame F is a first cavity 318 having a conduit 320 supplying pressurized gaseous material thereto. This pressurized gaseous material exits through apertures or orifices 322 in a spiral configuration. Similarly, a second cavity 324 has a conduit 326 connected to a source of pressurized gaseous material which in turn exits through apertures 328 in the desired spiral configuration. As will be noted, chamber 330 is convergent in the direction of fiber travel.

The fibers, having the vortex configuration are discharged onto a grooved suction roll 314 proximate a point of juxtaposition of a pressure roll 332 therewith. The first fibers thus deposited will have the desired pre-twist which will be a fairly loose twist.

Subsequently, fibrous material fed by feed-in roll 336 to opening roll 338 will be juxtaposed to the pre-twisted strand of first fibers. Subsequently, the composite material may undergo a twisting operation as is illustrated.

In one embodiment, a friction spindle bushing 340 may be employed. Such a device is well known in the art and need not be discussed in detail herein.

Alternatively, a modified magnetic spindle twister generally designated by reference numeral 342 may be used. In this embodiment, the twister includes an annular plate 344 operatively connected to a suction source or means. The twister includes an inner tube or conduit 346 through which the composite material passes; within tube 346 are a plurality of slots 348 through which a suction force is applied to exert a suction on the composite material thereby wrapping the outer fibers around the inner layer or core. This will occur to an extent that it will amplify the amount of twist in the yarn passing through the twister. The yarn then may pass between the nip of a pair of revolving rolls 350 and 352 which create the second pinch point for the method and apparatus.

Figures 6, 6A:
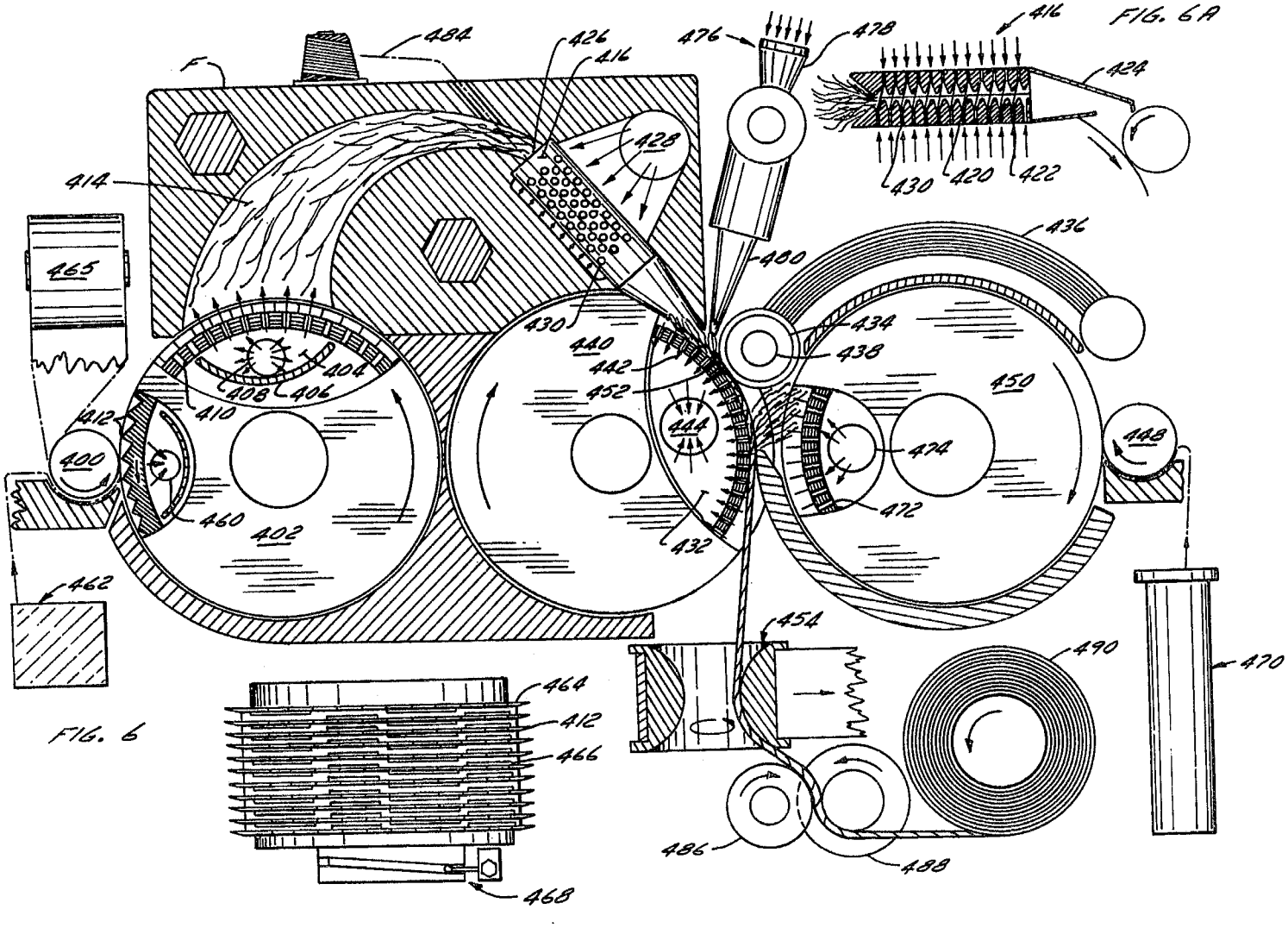
FIG. 6 is a cross-sectional view, partly in section, of a further type of fiber delivery system.
FIG. 6A is a cross-sectional view of the tubular fiber delivery device of FIG. 6.

A still further embodiment of the apparatus is illustrated in FIG. 6 and reference will now be made thereto.

The apparatus includes a feed-in roll 400 by which a source of fibrous material is fed to opening roll 402 having a plurality of teeth 412 and containing apertures 410. An internal cavity 404 is formed between the circumferential surface and boundary plate 406 and in which cavity there is a conduit 408 supplying pressurized gaseous material thereto.

The fibers which are combed and drafted by opening roll 402, are discharged therefrom after being combed and drafted by the gaseous material emanating from conduit 408. The fibers are discharged into a converging chamber 414 in frame F. The fibers then enter a vortex tube 416 at point 426. Vortex tube 416, as is illustrated in FIG. 6A, has a mouth portion 418 converging to an internal aperture 420 extending axially through the tube. The interior surface about aperture 420 is formed in the configuration of a helix through the use of grooves 422. Vortex tube 416 further includes a convergent discharge portion generally designated by reference numeral 424.

Within the frame, there is mounted a pressurized gaseous supply conduit 428 which supplies pressurized gaseous material to vortex tube 416 through apertures 430 therein. As will be seen from the Figure, discharge portion 424 is placed in close proximity to a fiber-receiving roll 440 which is in the form of a suction roll having apertures 442 communicating with a cavity 432 whereby a differential pressure is created through conduit 444.

Also mounted in close proximity to the point of discharge of the fibers is a pressure roll 434 journalled on shaft 438 and spring biased against the grooved suction roll through arm 436. This creates a first pinch point 452 whereby the fibers are pre-twisted in the manner explained with respect to FIGS. 1 and 3.

The illustrated apparatus also includes a further feed-in roll 448 and opening roll 450 of supplying a source of second fibers which are then placed in juxtaposition to the strand formed of the first fibers. The composite material then passes through a twisting device 454 similar to that illustrated in FIG. 3.

Vortex tube or unit 416 can be an interchangeable element. As discussed, the inside surface of vortex tube 416 resembles a thread configuration with a plurality of grooves 422 with the apertures or orifices 430 through which the gaseous pressurized material is directed being located in the bottom of each "thread". As will be appreciated, the high compressive forces of the pressurized gaseous material as well as the helical arrangement of grooves 422 compact the fibers and impart a helical construction into the strand in its pretwist delivery condition. Desirably, the exit or delivery portion 424 of tube 416 is shaped to mate with the suction roll surface which will absorb the air flow emanating from the tube.

The above-described apparatus of FIG. 6 through the use of tube 416, forces the fibers into the screw-like grooved cavities into a rotating helical twist-imparting form under the continuous high compression forces of the pressurized gaseous material. This air, as was discussed with respect to previous embodiments, may be in a jet configuration to achieve a texturizing effect on the fibers and thus the yarn being formed. Furthermore, the pressurized gaseous material may be humidified or otherwise suitably modified to have a desired effect on the fibers.

The helix angle inside the tube 416 can be varied depending on the fibers being employed and the yarn being produced. Thus, it may be either steep or shallow and the grooved notched configuration can be steep-walled or obtuse depending on the operating parameters of the process.

The arrangement illustrated in FIG. 6 contains several novel features and the illustrated apparatus is capable of forming a wide range of "types" of yarns. Thus, for example, opening roll 402 has teeth 412 and there is provided an internal conduit 460 supplying a suction to the surface of the roll through apertures 410. Thus, the materials delivered through feed-in roll 400 are "pulled" into closer engagement with the teeth. The suction provided may also be of assistance in cooling and withdrawing impurities from the material at this take-in point. The arrangement is designed to accept not only staple fiber materials, but also to act to convert to a yarn-forming material any type of tape or plastic film, metallic foils, paper materials, textile fabric materials, etc. All these materials, in addition to others, may be shredded into fiber form and used as a yarn-forming material. Thus, a conventional fibrous material such as that schematically illustrated by reference numeral 462 as well as the aforementioned further materials designated by reference character 465 may be fed to opening roll 402.

As shown in FIG. 6A, opening roll 402 may take different forms. Thus, as illustrated, opening roll 402 is comprised of an assembly of stamped, very thin metallic discs 464 which have teeth 412. The discs 464 have teeth 412 at the periphery and arranged in a stacked manner with spacers 466 intermediate each disc whereby the relative axial position of tooth protrusion can be in a "lined up" relationship or alternatively, in any desired pattern or randomly staggered relationship. The teeth 412 on discs 464 can be stamped to any desired shape or configuration including symmetrical angles, sharp or obtuse angles, forward or backward rake, etc. In addition, in the axial plane, each of the teeth 412 can be bent in any desired direction such as that known in a conventional "saw" arrangement where they are somewhat offset with respect to each other. The thickness of the discs may be selected depending on the materials utilized. If desired, one may vary the thickness of discs 464 in any one opening roll—i.e. it may include several thicknesses at various positions along the axis with respect to each other such as may be achieved by every second or every third disc being of a different thickness with respect to adjacent discs. Furthermore, discs 464 may be shaped in such a manner as to create slots of any desired cross-sectional shape or size through which the pressurized air may pass from the inside of the roller such as from conduit 408.

Depending on the density of the teeth 412 and the arrangement thereof, the staple length produced by opening roll 402 can be controlled in such a manner that the fibers employed in the apparatus can be placed in a staggered relationship to each other. This can be further aided by an oscillating mechanism whereby the roll 402 oscillates in a direction parallel to its rotational axis. Thus, as designated by reference numeral 468, a pin and cam arrangement may produce the desired oscillating motion. Obviously, any suitable mechanical arrangement known to those skilled in the art may be employed to achieve a similar function.

Also as illustrated in FIG. 6, feed-in roll 448 may feed in conventional staple fiber sliver 470 to opening roll 450 which is an aperture opening roll having apertures 472. The fibers may be d fed through use of a pressurized gaseous material supplied through conduit 474 if so desired. Alternatively, the fiber release may be accomplished by employing a sufficiently high peripheral velocity of opening roll 450.

A further device 476 may be employed in the present invention to achieve further yarn combinations. Thus, device 476 may comprise an extruder-like device or a molten polymer supply manifold. In the case of the extruder type device, pellets of a polymeric material can be supplied to a hopper 478 and a die nozzle 480 concentrates its nip into the yarn-forming zone at the exit of tube 416 which is just prior to the first pinch point created by pressure roll 434. The extrusion device 476 may be operated in a number of alternative manners. Basically, device 476 may function to finely subdivide the polymeric material which can be, for example, in the form of fibrids, and introduce the same into the yarn-forming zone. By so doing, any desired polymeric material can be added to the yarn and greatly enhance the strength thereof. The introduction of the polymeric material may be achieved through, for example, high pressure, high speed subdivision through the use of a combination of any of the known fibrid-making techniques including hot air blasting, explosive solvent or foaming agent release in the flash spinning mode, etc. If so desired, other techniques may be employed aided by a special serrated configuration of the nozzle. The introduction of a small amount of the fiber materials into the yarn will result in the incorporation of some of the most desirable properties of these materials into the final yarn thus giving it advantages heretofore unachievable. Such advantages include chemical and physical advantages such as tensile and strength characteristics, softness of feel in hand, etc. The well known high specific surface and absorbability of these fibers will give improved dye pickup. In addition, the life and abrasion resistance of the products will be increased.

Still further, the apparatus may incorporate a source of filamentary material 482 which is fed as a filament 484 through the center of vortex tube 416. Filament 484 may be of any desired material including, for example, continuous synthetic multifilaments, continuous synthetic monofilaments, ribbons or tape of any material, metallic wires or other continuous filaments, unoriented or partially oriented synthetic polymeric multifilaments, monofilaments and ribbons, a spun yarn or twisted fibrous strand including long staple fiber groupings, jute yarns, sisal yarns, glass or ceramic filamentous materials, elastic materials such as elastomers or rubbers, and combinations thereof.

As aforementioned, the yarn, once formed, may be fed to a suitable twisting device 454. Many alternative spindles may be used in lieu of that specifically illustrated including, for example, multiple wrap godet rolls or pinch rolls, multiple V-grooved rolls, etc. Following the twisting operation, the second pinch point is created by passing the composite yarn between a pair of rolls 486 and 488 following which there is formed a wound yarn package 490.

It has been found that employing the above-described apparatus, a "tight" pre-twist may be imparted to the first fibers. In this respect, it would be particularly suitable for forming a yarn without the use of the optional twister arrangement 454.

Figure 7:
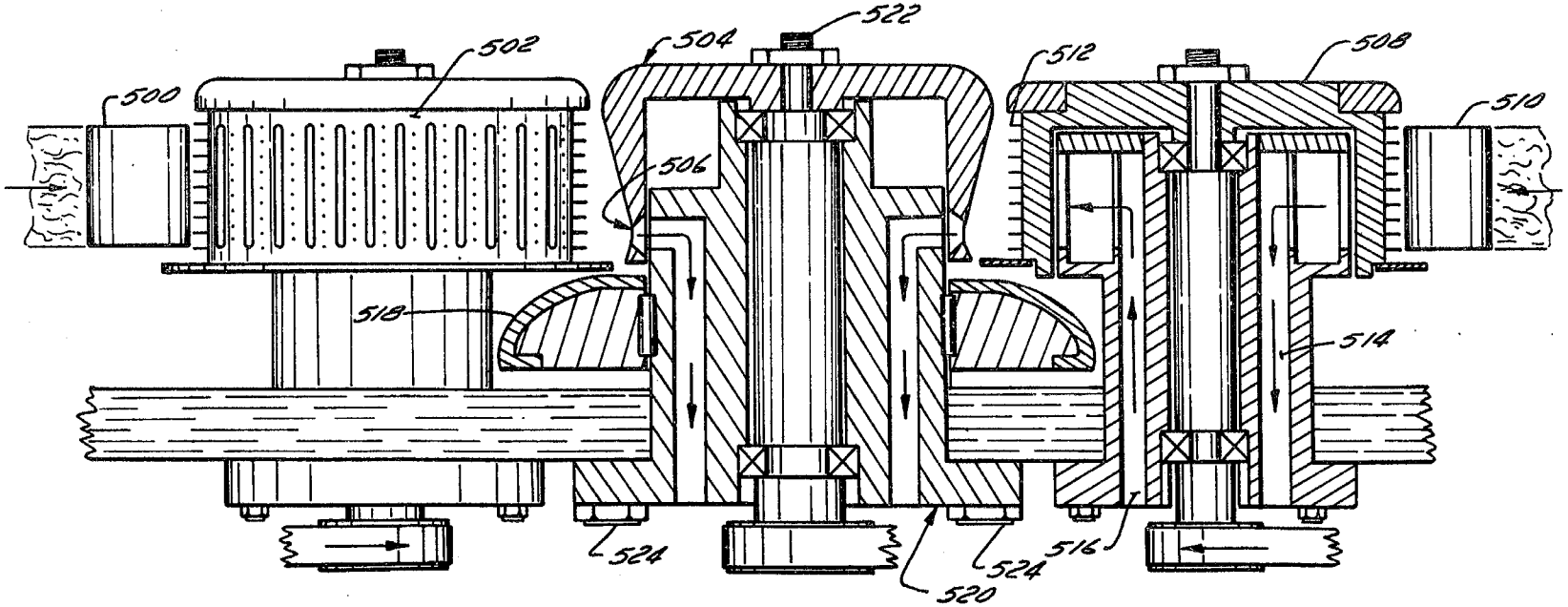
FIG. 7 is a top elevational view, partly in section, of a further embodiment of an apparatus constructed according to the present invention.

A still further embodiment of a composite yarnforming apparatus is illustrated in FIG. 7 to which reference will now be made.

The illustrated apparatus includes a feed-in roll 500 and a first opening roll 502. Mounted proximate opening roll 502 is a grooved suction roll 504 which, as may be seen from FIG. 7, has a groove 506 offset with respect to the center line of opening roll 502. By employing the offset position of groove 506, the fibers which are doffed from opening roll 502 and deposited on roll 504 are forced to move to one side to collect in the groove 506. Furthermore, the yarn formed in groove 506 will be in closer proximity to a rotating friction disc as will be discussed in greater detail hereinafter. A further advantage of the offset arrangement of the groove is that the same permits the installation of baffles or sealing plates to create an enclosed chamber and controlled air flow thereby preventing fly and containing and controlling any possibility of loose fibers moving externally of the system.

A second feed-in roll 510 feeds a fibrous material to a second opening roll 508 which is shown in cross-section. Opening roll 508, as was discussed with respect to previous opening rolls, is apertured and has a plurality of needles or teeth 512 on the circumferential surface thereof. As may be seen, a first conduit 514 applies a suction force to a portion of opening roll 508 while a further conduit 516 is connected to a source of gaseous pressurized material to discharge the fibers from the opening roll.

Mounted below the suction roll 504 is a friction disc 518 similar to that described with respect to FIG. 2. Friction disc 518 can be of any solid material or coated with any preferred and desirable surface material for yarn contact efficiency by employing abrasion resistant or controlled friction factor surfaces. As may be seen, friction disc 518 has a bent radium shape to induce a better yarn to surface contact and create twist differentials between the approach side and exit side yarn contact with the twisting element. If desired, the friction disc may be heated or cooled by internal means depending on the yarn product being formed.

FIG. 7 also illustrates a manner in which the various components of the apparatus may be constructed for easy removal and disassembly. Thus, suction roll 504 may be mounted on a bearing spindle arrangement 520 which is designed so that it is a removable cartridge assembly. In other words, suction roll 504 can be removed by undoing a suitable screw connection 522 and then the cartridge 520 can be removed through the rear by undoing bolts 524. Opening rolls 502 and 508 may be constructed in a similar manner.

Figure 8:
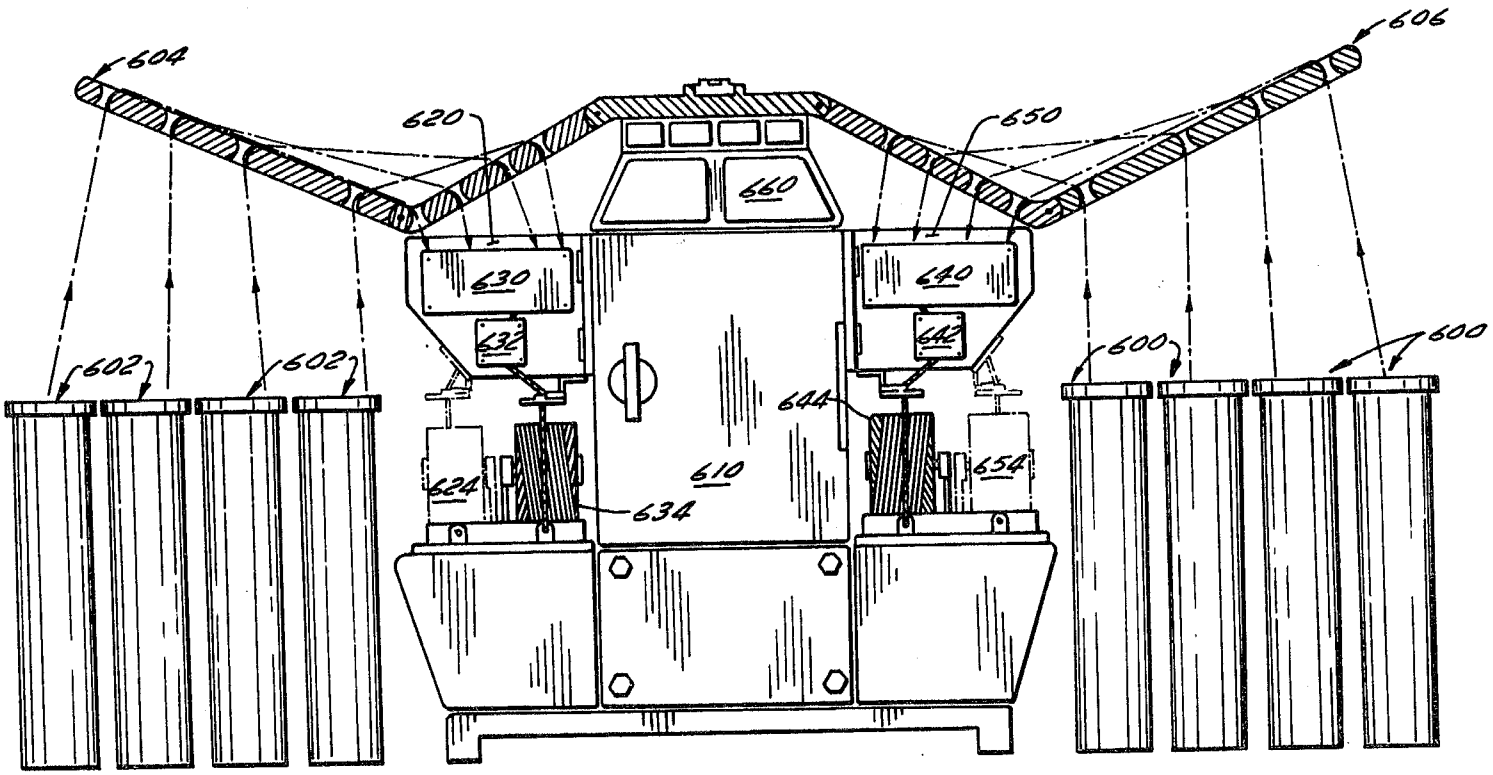
FIG. 8 is a side elevational view of an assembled apparatus employing the modular concept.

FIG. 8 is a side elevational view of an apparatus having four spinning positions. In this embodiment, there is provided a central module 610 which may include the central drive and auxiliary equipment including vacuum and pressure supply and drive controls for the various machine components.

As aforementioned, there are provided four spinning positions 620, 630, 640 and 650. For each spinning position there is provided a suitable twisting device—i.e. 632, 642, and wind-up means 634, 644.

The supply of the sliver material is designated by reference numeral 600 and 602 and as may be seen, the sliver material may be fed through sliver guiding mechanisms 606 and 604 respectively. The control indicators and operating panels may be conveniently mounted on top of the apparatus as indicated by reference numeral 660.

It will be understood that in the above-described embodiments, modifications may be made thereto. Thus, for example, in FIG. 4 disc 148 may have an inner tubular member 154 passing therethrough and to which a carrier material is fed. In this embodiment, the fibers from opening roll 128 are then pre-twisted about an inner carrier with the second source of fibers also being twisted thereabout in the same direction as the first or alternatively, in an opposed direction.

Still further, the inner carrier may be of a thermoplastic polymeric material which is passed through a heating zone to render the same tacky and improve the retention of the twist when the first fibers are deposited thereon. Also, the inner carrier may be passed through an extruder to have a thermoplastic polymeric material deposited thereon.

Thus, according to these various embodiments, one may have a composite yarn formed of an inner layer of fibers twisted in the S direction with an outer layer of fibers also twisted in the S direction. In a second embodiment, the inner layer of fibers may have an S direction twist with the outer fibers having a Z direction twist. Employing a carrier one may have an inner bulk carrier with a first layer of fibers having an S direction twist as does the second; alternatively, the first layer may have an S direction twist with the second having a Z direction twist. In a still further embodiment, the application of a tacky thermoplastic polymeric material will form a yarn having an inner carrier, a "sheath" of polymeric material having the first fibers embedded therein having a twist in the S direction and a second layer of fibers not adhering to the thermoplastic material but having a true twist in either the same direction as the first layer or opposed thereto.

Within the scope of this invention, it will be understood that various changes and modifications may be made to the above-described embodiments. Furthermore, the operating parameters can readily be determined in accordance with said teachings. For example, the air flow through the vortex tube applying the pre-twisting to the first fibers can be calculated to provide an air flow which is capable of being absorbed through the suction roll. The amount of air introduced need not be excessive, but rather the velocity and helical angle can be designed for any particular air flow. For example, the amount of air can be significantly reduced and modified by inserting smaller and smaller plugs into the fiber pre-twisting zone. In the embodiment above-described wherein reversal of the air direction or control thereof is desired, a V-shaped plug can be inserted on the bottom of the exposed V groove of the suction roll to prevent or seal off air flow from the surrounding area through the gap between the flat surface of the bottom of the mechanism and the V groove opening of the suction roll at a position where there are no fibers on said suction roll groove.

Furthermore, it will be appreciated that different features of the various embodiments may be combined in different apparatuses. For example, the suction roll having the offset groove is being described with respect to the embodiment of FIG. 7; such a suction roll may equally well be employed in any other of the described embodiments.

I claim:

1. A method suitable for manufacturing a yarn product comprising the steps of supplying first fibers, aerodynamically forcing said fibers to assume a vortex configuration to thereby impart a pre-twist to said first fibers to form a strand, passing said strand between first and second pinch points and while said strand is between said first and second pinch points, juxtaposing second fibers with said strand to form a yarn product.

2. A method as defined in claim 1 including the step of twisting said yarn product while between said first and second pinch points.

3. A method as defined in claim 1, wherein the step of supplying a source of first fibers comprises the step of supplying a non-particulate fibrous material, drafting and combing said fibrous material to form fibers, and directing said fibers into a stream of pressurized gaseous material having a vortex configuration.

4. A method as defined in claim 3, wherein the step of juxtaposing said second fibers to said strand comprises the step of supplying a non-particulated fibrous material, combing and drafting said fibrous material to form fibers, and directing said fibers into juxtaposition with said strand.

5. A method as defined in claim 1, wherein the step of imparting a pre-twist to said first fibers includes the step of supplying pressurized gaseous material having a vortex configuration, directing said fibers into said stream of pressurized gaseous material, discharging said fibers on a movable collecting surface to form a layer of the same, and creating a first pinch point proximate the point at which said first fibers are discharged on said movable collecting surface.

6. A method as defined in claim 1, wherein said second fibers are pneumatically directed in juxtaposition to said strand of first fibers in a direction co-current with the direction of movement of said layer of first fibers.

7. A method suitable for manufacturing a yarn product comprising the steps of supplying a first pre-twisted strand, passing said strand between first and second pinch points, and while said strand is between said first and second pinch points, aerodynamically directing second fibers in juxtaposition with said strand in a direction substantially counter-current with respect to the direction of movement of the strand to form a yarn product.

8. A method as defined in claim 1, wherein said second fibers are pneumatically directed in juxtaposition to said strand of first fibers in a direction substantially perpendicular to the direction of movement of said strand.

9. A method as defined in claim 2, wherein the step of twisting said yarn product comprises the step of false-twisting said yarn product.

10. A method for manufacturing a yarn product comprising the steps of supplying a first pre-twisted strand, passing said strand between first and second pinch points, false twisting the strand while between said first and second pinch points in the same direction as the pre-twist imparted to said first fibers, and juxtaposing second fibers to said strand to form a yarn product.

11. A method for manufacturing a yarn product comprising the steps of supplying first fibers, imparting a pre-twist to said first fibers to form a strand, passing said strand between first and second pinch points, imparting a twist to said strand while between said first and second pinch points in a direction opposed to the direction of pre-twist imparted to the first fibers, and juxtaposing second fibers with said strand to form a yarn product.

12. A method for manufacturing a yarn product comprising the steps of supplying a continuous filament of a yarn forming material, pre-twisting first fibers about said filament to form a strand, passing said strand between first and second pinch points and while said strand is between said first and second pinch points, juxtaposing second fibers with said strand to form a yarn product.

13. A method suitable for manufacturing a yarn product comprising the steps of supplying first fibers, imparting a pre-twist to said first fibers to form a strand, passing said strand between first and second pinch points and while said strand is between said first and second pinch points, juxtaposing second fibers with said strand to form a yarn product, and subjecting said yarn product to a final twisting step after exit from said second pinch point.

14. An apparatus suitable for manufacturing a yarn product, the apparatus comprising a fiber delivery device through which said first fibers pass having means for directing a source of pressurized gaseous material in a vortex configuration for imparting a pre-twist to first fibers to form a strand of the same, means forming first and second pinch points through which said strand passes to maintain the pre-twist imparted to said first fibers, and means for juxtaposing second fibers with said strand while said strand is between said first and second pinch points to form the yarn product.

15. An appparatus as defined in claim 14, including means for imparting a further twist to said yarn product while between said first and second pinch points.

16. An apparatus suitable for manufacturing a yarn product, the apparatus comprising means for supplying a continuous filament of a yarn forming material, means for imparting a pre-twist to first fibers about said continuous filament to form a strand, means forming first and second pinch points through which said strand passes, and means for juxtaposing second fibers with said strand while said strand is between said first and second pinch points.

17. An apparatus for manufacturing a yarn product, the apparatus comprising means for imparting a pre-twist to first fibers, a rotatable section roll on which said first fibers are deposited to form a strand of the same, a pressure roll in juxtaposition with said section roll to create a first pinch point through which said strand passes, a second pinch point through which said strand passes, and means for juxtaposing second fibers with said strand while said strand is between said first and second pinch points to form the yarn product.

18. An apparatus as defined in claim 14 wherein said means for juxtaposing said second fibers includes means for pneumatically directing said second fibers in a direction co-current to the direction of travel of said strand.

19. An apparatus as defined in claim 14 including means for directing a source of pressurized gaseous material contracurrent to the direction of movement of the yarn product, said means being located between said pinch points.

* * * * *